US006749485B1

(12) United States Patent
James et al.

(10) Patent No.: US 6,749,485 B1
(45) Date of Patent: Jun. 15, 2004

(54) HYDROLYTICALLY STABLE GROOVED POLISHING PADS FOR CHEMICAL MECHANICAL PLANARIZATION

(75) Inventors: David B. James, Newark, DE (US); Arun Vishwanathan, Wilmington, DE (US); Lee Melbourne Cook, Steelville, PA (US); Peter A. Burke, Avondale, PA (US); David Shidner, Newark, DE (US); Joseph K. So, Newark, DE (US); John V. H. Roberts, Newark, DE (US)

(73) Assignee: Rodel Holdings, Inc., Wilmington, DE (US)

( * ) Notice: Subject to any disclaimer, the term of this patent is extended or adjusted under 35 U.S.C. 154(b) by 0 days.

(21) Appl. No.: 09/665,841

(22) Filed: Sep. 20, 2000

Related U.S. Application Data

(63) Continuation-in-part of application No. 09/631,783, filed on Aug. 3, 2000, and a continuation-in-part of application No. 09/631,784, filed on Aug. 31, 2000, and a continuation-in-part of application No. 09/608,537, filed on Jun. 30, 2000.

(60) Provisional application No. 60/222,099, filed on Jul. 28, 2000, and provisional application No. 60/207,938, filed on May 27, 2000.

(51) Int. Cl.[7] ..... B24B 1/00

(52) U.S. Cl. ..... 451/41; 451/63; 451/527; 451/921; 51/296; 51/309

(58) Field of Search ..... 451/41, 63, 527, 451/548, 550, 921; 51/296, 298, 299, 307, 309

(56) References Cited

U.S. PATENT DOCUMENTS

| | | | | |
|---|---|---|---|---|
| 3,889,430 A | * | 6/1975 | Scandaletos | 451/546 |
| 4,568,611 A | | 2/1986 | Amirsakis et al. | |
| 4,569,982 A | | 2/1986 | Glogler et al. | |
| 4,927,432 A | * | 5/1990 | Budinger et al. | 427/389.9 |
| 5,007,207 A | * | 4/1991 | Phaal | 175/428 |
| 5,017,265 A | | 5/1991 | Jenkins et al. | |
| 5,081,051 A | * | 1/1992 | Mattingly et al. | 438/693 |
| 5,177,908 A | * | 1/1993 | Tuttle | 451/287 |
| 5,247,765 A | * | 9/1993 | Quintana | 451/548 |
| 5,394,655 A | * | 3/1995 | Allen et al. | 451/41 |

(List continued on next page.)

FOREIGN PATENT DOCUMENTS

| | | |
|---|---|---|
| EP | 0 520 643 A | 12/1992 |
| EP | 0 878 270 A2 | 11/1998 |
| WO | WO 98 300356 A | 7/1998 |
| WO | WO 98 45090 A | 10/1998 |
| WO | WO 99 05192 A | 2/1999 |

OTHER PUBLICATIONS

Murarka, S. P., Steigerwald, J., Gutmann, R. J., "Inlaid Copper Multilevbel Interconnections Using Planarization by Chemical–Mechanical Polishing", MRS Bulletin, pp. 46–51, Jun. 1993.

Baker, A. Richard, "The Origin of the Edge Effect in CMP", Electrochemical Society Proceedings, vol. 96–22, pp. 228–238, Oct. 1996.

*Primary Examiner*—Joseph J. Hail, III
*Assistant Examiner*—Anthony Ojini
(74) *Attorney, Agent, or Firm*—Konrad Kaeding; Blake T. Biederman

(57) ABSTRACT

An improved pad and process for polishing metal damascene structures on a semiconductor wafer. The process includes the steps of pressing the wafer against the surface of a polymer sheet in combination with an aqueous-based liquid that optionally contains sub-micron particles and providing a means for relative motion of wafer and polishing pad under pressure so that the moving pressurized contact results in planar removal of the surface of said wafer, wherein the polishing pad has a low elastic recovery when said load is removed, so that the mechanical response of the sheet is largely anelastic. The improved pad is characterized by a high energy dissipation coupled with a high pad stiffness and hydrolytic stability.

31 Claims, 5 Drawing Sheets

U.S. PATENT DOCUMENTS 5,489,233 A * 2/1996 Cook et al. ..... 451/41
5,534,345 A 7/1996 Bradshaw
5,569,062 A * 10/1996 Karlsrud ..... 451/285
5,578,362 A 11/1996 Reinhardt et al.
5,580,647 A 12/1996 Larson et al.
5,605,760 A 2/1997 Roberts
5,900,164 A 5/1999 Budinger et al.
6,022,268 A 2/2000 Roberts et al.
6,217,434 B1 4/2001 Roberts et al.
6,293,852 B1 9/2001 Roberts et al.
6,454,634 B1 9/2002 James et al.
2002/0058469 A1 5/2002 Pinheiro et al.
2002/0077036 A1 6/2002 Roberts et al.

* cited by examiner

HYDROLYTICALLY STABLE GROOVED POLISHING PADS FOR CHEMICAL MECHANICAL PLANARIZATION

This application is a CIP of U.S. application Ser. No. 09/631,783 filed on Aug. 3, 2000, a CIP of U.S. application Ser. No. 09/631,784 filed on Aug. 3, 2000; and a CIP of U.S. application Ser. No. 09/608,537 filed on Jun. 30, 2000. This application also claims the benefit of U.S. Provisional Application No. 60/222,099 filed on Jul. 28, 2000 and U.S. Provisional Application No. 60/207,938 filed on May 27, 2000.

The present invention relates generally to improved polishing pads used to polish and/or planarize substrates, particularly metal or metal-containing substrates during the manufacture of a semiconductor device. Specifically, this invention relates to pads manufactured with an optimized combination of physical properties and a grooved surface engineered to a specific design to provide improved polishing performance.

Chemical-mechanical planarization ("CMP") is a process currently practiced in the semiconductor industry for the production of flat surfaces on integrated circuits devices. This process is discussed in "Chemical Mechanical Planarization of Microelectronic Materials", J. M. Steigerwald, S. P. Murarka, R. J. Gutman, Wiley, 1997, which is hereby incorporated by reference in its entirety for all useful purposes. Broadly speaking, CMP involves flowing or otherwise placing a polishing slurry or fluid between an integrated circuit device precursor and a polishing pad, and moving the pad and device relative to one another while biasing the device and pad together. Such polishing is often used to planarize: i. insulating layers, such as silicon oxide; and/or ii. metal layers, such as tungsten, aluminum, or copper.

As semiconductor devices become increasingly complex (requiring finer feature geometries and greater numbers of metallization layers), CMP must generally meet more demanding performance standards. A relatively recent CMP process has been the fabrication of metal interconnects by the metal damascene process (see for example, S. P. Murarka, J. Steigerwald, and R. J. Gutman, "*Inlaid Copper Multilevel Interconnections Using Planarization by Chemical Mechanical Polishing*", MRS Bulletin, pp. 46–51, June 1993, which is hereby incorporated by reference in its entirety for all useful purposes).

With damascene-type polishing, the polished substrate is generally a composite rather than a homogenous layer and generally comprises the following basic steps: i. a series of metal conductor areas (plugs and lines) are photolithographically defined on an insulator surface; ii. the exposed insulator surface is then etched away to a desired depth; iii. after removal of the photoresist, adhesion layers and diffusion barrier layers are applied; iv. thereafter, a thick layer of conductive metal is deposited, extending above the surface of the insulator material of the plugs and lines; and v. the metal surface is then polished down to the underlying insulator surface to thereby produce discrete conductive plugs and lines separated by insulator material.

In the ideal case after polishing, the conductive plugs and lines are perfectly planar and are of equal cross-sectional thickness in all cases. In practice, significant differences in thickness across the width of the metal structure can occur, with the center of the feature often having less thickness than the edges. This effect, commonly referred to as "dishing", is generally undesirable as the variation in cross-sectional area of the conductive structures can lead to variations in electrical resistance. Dishing arises because the harder insulating layer (surrounding the softer metal conductor features) polishes at a slower rate than the metal features. Therefore, as the insulating region is polished flat, the polishing pad tends to erode away conductor material, predominantly from the center of the metal feature, which in turn can harm the performance of the final semiconductor device. Grooves are typically added to polishing pads used for CMP for several reasons:

1. To prevent hydroplaning of the wafer being polished across the surface of the polishing pad. If the pad is either ungrooved or unperforated, a continuous layer of polishing fluid can exist between the wafer and pad, preventing uniform intimate contact and significantly reducing removal rate.
2. To ensure that slurry is uniformly distributed across the pad surface and that sufficient slurry reaches the center of the wafer. This is especially important when polishing reactive metals such as copper, in which the chemical component of polishing is as critical as the mechanical. Uniform slurry distribution across the wafer is required to achieve the same polishing rate at the center and edge of the wafer. However, the thickness of the slurry layer should not be so great as to prevent direct pad-wafer contact.
3. To control both the overall and localized stiffness of the polishing pad. This controls polishing uniformity across the wafer surface and also the ability of the pad to level features of different heights to give a highly planar surface.
4. To act as channels for the removal of polishing debris from the pad surface. A build-up of debris increases the likelihood of scratches and other defects.

The "Groove Stiffness Quotient" ("GSQ") estimates the effects of grooving on pad stiffness and is hereby defined as Groove Depth (D)/Pad Thickness (T). Hence, if no grooves are present, the GSQ is zero, and at the other extreme (if the grooves go all the way through the pad) the GSQ is unity. The "Groove Flow Quotient" ("GFQ") estimates the effects of grooving on (pad interface) fluid flow and is hereby defined as Groove Cross-Sectional Area (Ga)/Pitch Cross-Sectional Area (Pa), where $Ga=D\times W$, $Pa=D\times P$, $P=L+W$; D being the groove depth, W being the groove width, L being the width of the land area, and P being the pitch. Since D is a constant for a particular groove design, the GFQ may also be expressed as the ratio of groove width to pitch Groove Width (W)/Groove Pitch (P).

The present invention is directed to (i) polishing pads for CMP having low elastic recovery during polishing, while also exhibiting significant anelastic properties relative to many known polishing pads; and (ii) polishing pads with defined groove patterns having specific relationships between groove depth and overall pad thickness and groove area and land area. In some embodiments, the pads of the present invention further define: i. an average surface roughness of about 1 to about 9 micrometers; ii. a hardness of about 40 to about 70 Shore D; and iii. a tensile Modulus up to about 2000 MPa at 40° C. In one embodiment, the polishing pads of the present invention define a ratio of Elastic Storage Modulus (E') at 30° and 90° C. being 5 or less, preferably less than about 4.6 and more preferably less than about 3.6. In other embodiments of the present invention, the polishing pad defines a ratio of E' at 30° C. and 90° C. from about 1.0 to about 5.0 and an Energy Loss Factor (KEL) from about 100 to about 1000 (1/Pa) (40° C.). In other embodiments, the polishing pad has an average surface roughness of about 2 to about 7 micrometers, a hardness of about 45 to about 65 Shore D, a Modulus E' of about 150 to about 1500 MPa at 40° C., a KEL of about 125 to about 850 (1/Pa at 40° C.) and a ratio of E' at 30° C. and 90° C. of about 1.0 to about 4.0. In yet other embodiments, the polishing pads of the present invention have an average surface roughness of about 3 to about 5 micrometers, a hardness of about 55 to about 63 Shore D, a Modulus E' of 200 to 800 MPa at 40° C., KEL of 150 to 400 (1/Pa at 40° C.) and a ratio of E' at 30° C. and 90° C. of 1.0 to 3.6.

In one embodiment, the modulus value can be as low as about 100 MPa, provided the pad is sufficiently hydrolytically stable. Such stability is characterized by substantially stable pad performance as the pad is increasingly subjected to water-based fluids.

In another embodiment, the present invention is directed to polishing pads having a groove pattern with a groove depth in a range of about 75 to about 2,540 micrometers (more preferably about 375 to about 1,270 micrometers, and most preferably about 635 to about 890 micrometers), a groove width in a range of about 125 to about 1,270 micrometers (more preferably about 250 to about 760 micrometers, and most preferably about 375 to about 635 micrometers) and a groove pitch in a range of about 500 to about 3,600 micrometers (more preferably about 760 to about 2,280 micrometers, and most preferably about 2,000 to about 2,260 micrometers). A pattern with this configuration of grooves further provides a Groove Stiffness Quotient ("GSQ") in a range of from about 0.03 (more preferably about 0.1, and most preferably about 0.2) to about 1.0 (more preferably about 0.7, and most preferably about 0.4) and a Groove Flow Quotient ("GFQ") in a range of from about 0.03 (more preferably about 0.1, and most preferably about 0.2) to about 0.9 (more preferably about 0.4, and most preferably about 0.3).

In yet another embodiment, the pads of the present invention may be filled or unfilled and porous or non-porous. Preferred fillers include, but are not limited to, micro-elements (e.g., micro-balloons), abrasive particles, gases, fluids, and any fillers commonly used in polymer chemistry, provided they do not unduly interfere negatively with polishing performance. Preferred abrasive particles include, but are not limited to, alumina, ceria, silica, titania, germania, diamond, silicon carbide or mixtures thereof, either alone or interspersed in a friable matrix which is separate from the continuous phase of pad material.

The pads of this invention can be used in combination with polishing fluids to perform CMP upon any one of a number of substrates, such as, semiconductor device (or precursor thereto), a silicon wafer, a glass (or nickel) memory disk or the like. More detail may be found in U.S. Pat. No. 5,578,362 to Reinhardt et al. which is incorporated in its entirety for all useful purposes. The pad formulation may be modified to optimize pad properties for specific types of polishing. For example, for polishing softer metals, such as aluminum or copper, softer pads are sometimes required to prevent scratches and other defects during polishing. However, if the pads are too soft, the pad can exhibit a decreased ability to planarize and minimize dishing of features. For polishing oxide and harder metals such as tungsten, harder pads are generally required to achieve acceptable removal rates.

In yet another embodiment, the present invention is directed to a process for polishing metal damascene structures on a semiconductor wafer by: i. pressing the wafer against the surface of a pad in combination with an aqueous-based liquid that optionally contains sub-micron particles; and ii. providing mechanical or similar-type movement for relative motion of wafer and polishing pad under pressure so that the moving pressurized contact results in planar removal of the surface of said wafer.

The preferred pads of the present invention are characterized by high-energy dissipation, particularly during compression, coupled with high pad stiffness. Preferably, the pad exhibits a stable morphology that can be reproduced easily and consistently. Furthermore, the pad surface preferably resists glazing, thereby requiring less frequent and less aggressive conditioning and resulting in low pad wear and longer pad life. In one embodiment, the polishing pads of the present invention exhibit low dishing of metal features, low oxide erosion, reduced pad conditioning, high metal removal rates, good planarization, and/or lower defectivity (scratches and light point defects), relative to known polishing pads.

Furthermore, the pad surface has macro-texture. This macro-texture can be either perforations through the pad thickness or surface groove designs. Such surface groove designs include, but are not limited to, circular grooves which may be concentric or spiral grooves, cross-hatched patterns arranged as an X-Y grid across the pad surface, other regular designs such as hexagons, triangles and tire-tread type patterns, or irregular designs such as fractal patterns, or combinations thereof. The groove profile may be rectangular with straight side-walls or the groove cross-section may be "V"-shaped, "U"-shaped, triangular, saw-tooth, etc. Further, the geometric center of circular designs may coincide with the geometric center of the pad or may be offset. Also the groove design may change across the pad surface. The choice of design depends on the material being polished and the type of polisher, since different polishers use different size and shape pads (i.e. circular versus belt). Groove designs may be engineered for specific applications. Typically, these groove designs comprise one or more grooves. Further, groove dimensions in a specific design may be varied across the pad surface to produce regions of different groove densities either to enhance slurry flow or pad stiffness or both. The optimum macro-texture design will depend on the material being polished (i.e. oxide or metal, copper or Tungsten) and the type of polisher (e.g. IPEC 676, AMAT Mirra, Westech 472, or other commercially available polishing tools).

The following drawings are provided:

Commercially available pads used for CMP are typically about 1,300 micrometers thick. Pad thickness can contribute to the stiffness of the pad, which in turn, can determine the ability of the pad to planarize a semiconductor device. Pad stiffness is proportional to the product of pad modulus and cube of the thickness, and this is discussed in Machinery's Handbook, 23$^{rd}$ edition, which is incorporated by reference in its entirety for all useful purposes (see in particular page 297). Thus, doubling the pad thickness can theoretically increase stiffness eight-fold. To achieve planarization, pad thickness in excess of 250 micrometers is typically required. For next generation devices, pad thickness greater than 1,300 micrometers may be required. Preferred pad thickness is in the range of about 250 to about 5,100 micrometers. At a pad thickness above 5,100 micrometers, polishing uniformity may suffer because of the inability of the pad to conform to variations in global wafer flatness.

For a given pad thickness, increasing pad modulus will increase pad stiffness and the ability of the pad to planarize. Thus unfilled pads will planarize more effectively than filled pads. However, it is important to recognize that stiffness is proportional to the cube of thickness compared to only the single power of modulus, so that changing pad thickness can have a more significant impact than changing pad modulus.

Figure 1:
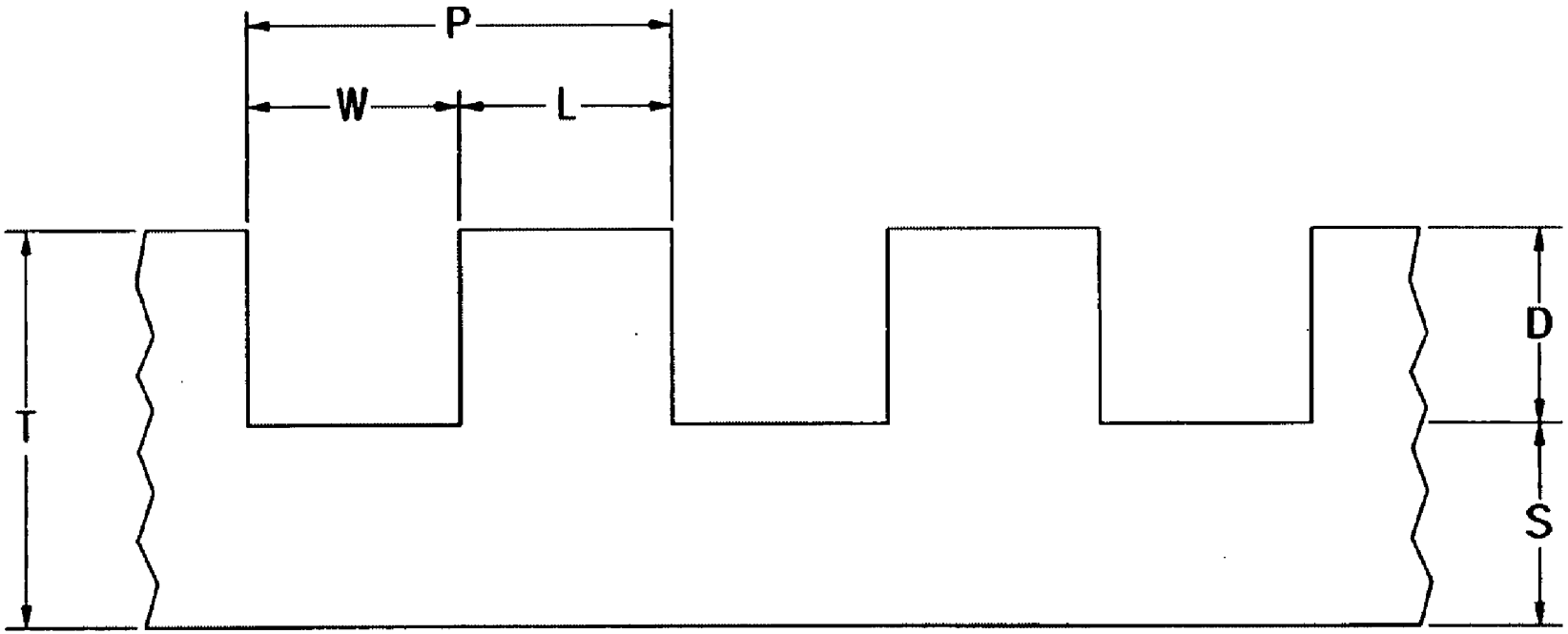
FIG. 1 illustrates pad and groove dimensions.

Although grooving the pad reduces its effective stiffness, slurry distribution is move uniform thereby resulting in higher planarity of the wafer surface being polished. In general, the deeper the grooves with respect to the pad thickness, the more flexible the pad becomes. FIG. 1 defines the critical dimensions of the grooved pad and shows GSQ relating groove depth to pad thickness, such that:

GSQ=Groove Depth (D)/Pad Thickness (T)

If no grooves are present, GSQ is zero and, at the other extreme, if the grooves go all the way through the pad, GSQ is unity.

A second parameter may be used to relate the groove area to the land area of the design. This is also shown in FIG. 1. A convenient method of showing this parameter is by calculating the ratio of the groove cross-sectional area to the total cross-sectional area of the groove repeat area (i.e. the pitch cross-sectional area), such that GFQ is defined as:

GFQ=Groove Cross-Sectional Area (Ga)/Pitch Cross-Sectional Area (Pa)

where $Ga=D\times W$, $Pa=D\times P$, $P=L+W$ where D is the groove depth, W is the groove width, L is the width of the land area, and P is the pitch. Since D is a constant for a particular groove design, GFQ may also be expressed as the ratio of groove width to pitch:

GFQ=Groove Width (W)/Groove Pitch (P)

The GSQ value generally affects pad stiffness, slurry distribution across the wafer, removal of waste polishing debris, and hydroplaning of the wafer over the pad. At high GSQ values the greatest effect is generally on pad stiffness. In the extreme case, where the groove depth is the same as the pad thickness, the pad comprises discrete islands which are able to flex independently of neighboring islands. Secondly, above a certain groove depth, the channel volume of the grooves will generally be sufficiently large to distribute slurry and remove waste independent of their depth. By contrast, at low GSQ values slurry and waste transport typically becomes the primary concern. At even lower GSQ values, or in the extreme case of no grooves, a thin layer of liquid can prevent pad and wafer from making intimate contact, resulting in hydroplaning and ineffective polishing.

In order to avoid hydroplaning of the wafer over the pad surface, the grooves must generally be deeper than a critical minimum value. This value will depend on the micro-texture of the pad surface. Typically, micro-texture comprises a plurality of protrusions with an average protrusion length of less than 0.5 micrometers. In some commercially available pads, polymeric microspheres add porosity to the pad and increase surface roughness, thereby reducing the tendency of hydroplaning and the need for aggressive pad conditioning. For filled pads, the minimum groove depth to prevent hydroplaning is about 75 micrometers and for unfilled pads about 125 micrometers. Thus assuming a reasonable pad thickness of say 2,540 micrometers, the minimum values of GSQ for filled and unfilled pads are 0.03 and 0.05 respectively.

One factor determining pad-life of grooved pads is the depth of the grooves, since acceptable polishing performance is possible only until the pad has worn to the point where grooves have insufficient depth to distribute slurry, remove waste, and prevent hydroplaning. In order to achieve the combination of acceptable pad stiffness and long pad-life, it is necessary to have deep grooves but also sufficient remaining pad to provide stiffness. As groove density and size increase, pad stiffness becomes more dependent on the thickness (S in FIG. 1) of the remaining ungrooved layer of the pad, rather than on groove depth alone.

Also as the pad wears, the overall pad thickness and corresponding stiffness decrease. Thus a high initial pad thickness can be advantageous, as the change in stiffness with polishing time will be relatively less for a thicker pad. For a grooved pad with deeper grooves, high thickness for the underlying ungrooved layer and for the overall pad are preferred, since stiffness LB can be less dependent on the groove depth in this case.

Pad stiffness is important, because it controls several important polishing parameters, including uniformity of removal rate across the wafer, die level planarity, and to a lesser extent dishing and erosion of features within a die. Ideally for uniform polishing, removal rate should be the same at all points on the wafer surface. This would suggest that the pad needs to be in contact with the whole wafer surface with the same contact pressure and relative velocity between pad and wafer at all points. Unfortunately, wafers are not perfectly flat and typically have some degree of curvature resulting from the stresses of manufacture and differing coefficients of thermal expansion of the various deposited oxide and metal layers. This requires the polishing pad to have sufficient flexibility to conform to wafer-scale flatness variability. One solution to this problem is to laminate a stiff polishing pad to a flexible underlying base pad, which is typically a more compressive, foam-type polymeric material. This improves polishing uniformity across the wafer without unduly compromising the stiffness of the polishing top pad.

Edge effects can also arise during polishing. This phenomenon manifests as non-uniformity in removal across the wafer surface, such that less material is removed near the wafer edge. The problem becomes worse as the stiffness of the top pad increases and the compressibility of the base pad increases. The phenomenon has been discussed by A. R. Baker in "*The Origin of the Edge Effect in CMP*", Electrochemical Society Proceedings, Volume 96-22, 228, (1996) which is incorporated by reference in its entirety for all useful purposes. By grooving the top pad, it is possible to reduce its stiffness and hence reduce edge effects. Top pad stiffness is important because it governs the ability of the pad to planarize die level features.

This is an important characteristic of a pad for chemical mechanical planarization and is the very reason that the CMP process is used. This is described in "*Chemical Mechanical Planarization of Microelectronic Materials*", J. M. Steigerwald, S. P. Murarka, R. J. Gutman, Wiley, (1997) which is incorporated by reference in its entirety for all useful purposes.

A typical integrated circuit die contains features, such as conductor lines and vias between layers, of different sizes and pattern densities. Ideally, it is required that as polishing proceeds, these features reach planarity independent of feature size and pattern density. This requires a stiff pad which will first remove high spots and continue to preferentially remove those high spots until the die surface is perfectly flat.

From a planarization perspective, ideally pads will have low GSQ values (corresponding to high stiffness) in order to planarize well. Since a pad filled with microballoons will have a lower modulus, thus lower stiffness, than a corresponding unfilled pad, the filled pad should have a lower GSQ value than the unfilled pad to achieve equivalent stiffness. This is consistent with the trend in GSQ from a hydroplaning perspective discussed above. The other important ratio is GFQ which relates groove width to pitch. This parameter determines the surface area of the pad in contact with the wafer, slurry flow characteristics across the pad and at the pad-wafer interface, and to a lesser extent pad stiffness.

As discussed above, pad stiffness is dependent on groove depth which may be adequately described by GSQ. It is also somewhat dependent on GFQ which encompasses the other groove dimensions. This dependency comes more from the groove pitch rather than the groove width. A razor thin groove will reduce stiffness almost as much as wider groove and the more grooves (lower pitch) in a pad, the lower the stiffness. Stiffness will therefore decrease as GFQ increases.

The table below shows modulus data measured parallel and perpendicular to circular grooves of a thin pad and a thick pad manufactured by Rodel Inc., which are otherwise substantially identical. The groove dimensions have been previously shown in the earlier table above. Also shown are values of pad thickness, calculated GSQ and GFQ parameters, and stiffness values normalized to the thin pad.

| Pad | T (micrometers) | GSQ | GFQ | Modulus (MPa) perpendicular | Modulus (MPa) parallel | Stiffness perpendicular | Stiffness parallel |
|---|---|---|---|---|---|---|---|
| Thin | 1,270 | 0.300 | 0.167 | 337 | 455 | 4.2E13 | 5.7E13 |
| Thick | 2,030 | 0.375 | 0.167 | 199 | 418 | 1.0E14 | 2.1E14 |

Several interesting observations are apparent from the data in above table. First, that the pad properties depend on the measurement direction. Both modulus and stiffness values are anisotropic and depend on whether measurements are made parallel or perpendicular to the groove direction. The pad is more flexible if the groove direction is perpendicular to the direction of curvature. This is an important consideration when designing pads for belt or roll type polishers, in which the pads have to move repetitively and rapidly around low radius drive cylinders. Anisotropy is greater for the thick pad relative to the thin pad.

Secondly, it is apparent that the stiffness of the thick pad is higher than that of the thin pad. The factor driving the higher value is the greater thickness of the thick pad. So although the modulus of the thin pad is higher than that of the thick pad and consistent with GSQ ratios, in this case for relatively low GSQ and GFQ values, thickness is more important than either GSQ or GFQ in determining stiffness. At high GSQ values, where groove depth approaches pad thickness, GSQ rather than pad thickness will determine stiffness.

Optimum groove design, and hence GSQ and GFQ parameters, depends on many factors. These include pad size, polishing tool, and material being polished. Although most polishers use circular pads and are based on planetary motion of pad and wafer, a newer generation of polishers is emerging based on linear pads. For this type of polisher, the pad can be either in the form of a continuous belt or in the form of a roll which moves incrementally under the wafer. As shown in the table below different polishers use pads of different sizes and geometry:

| Tool Supplier | Tool Name | Pad Shape | Pad Dimensions |
|---|---|---|---|
| Westech | 372, 472 | Circular | 57.2 cm diameter |
| AMAT | Mirra | Circular | 50.8 cm diameter |
| Strasbaugh | Symphony | Circular | 71.1–76.2 cm diameter |
| IPEC | 676 | Circular | 25.4 cm diameter |
| Speedfam | | Circular | 91.4 cm diameter |
| LAM | Teres | Belt | 30.5 cm × 238.8 cm |
| Obsidian | | Roll | 48.3 cm × 762 cm |
| Ebara | | Circular | 57.2 cm diameter |

For circular pads, slurry is typically introduced at the pad center and centrifugally transported to the pad edge. Thus, for larger pads, slurry transport becomes more challenging and may be enhanced by grooving the pad surface. Concentric grooves can trap slurry on the pad surface and radial grooves or cross-hatch designs can facilitate flow across the pad surface. Thus, for larger pads it is advantageous to have a denser groove design or, in other words, a higher GFQ ratio. The IPEC 676 polisher uses small pads but slurry is introduced through the pad to the wafer surface. A grid of X-Y grooves is therefore required to transport the slurry from the feed holes across the pad surface. For linear polishers, grooves not only facilitate slurry flow, they are also needed to make the pad more flexible so that it can repetitively bend around the drive mechanism. Thus pads for linear polishers tend to be fairly thin with deep grooves and high GSQ ratios. Also grooves are preferentially cut perpendicular rather than parallel to the length of the pad.

As the name suggests, CMP polishing is a process which involves both mechanical and chemical components. The relative importance of each of these depends on the material being polished. For example, hard materials, such as oxide dielectrics and tungsten, require a fairly hard pad since removal is predominantly determined by the mechanical properties of the pad. For more reactive materials, such as copper and aluminum, softer pads are preferred and the chemical component becomes more important. Thus for materials such as oxide or tungsten, higher modulus, stiffer pads are preferred with lower GSQ and GFQ ratios. In contrast, for materials such copper and aluminum, slurry transport across the pad surface is critical, which is favored by higher GSQ and GFQ values. As an example of the latter, copper polishing rates are often low at the center of a wafer because of slurry starvation. This can be remedied by adding X-Y grooves to the usual circular ring design, thus increasing slurry flow at the center of the wafer.

As a first approximation, polishing removal rate is determined by Preston's equation described in F. W. Preston, J. Soc. Glass Tech., XI, 214,(1927) which is incorporated by reference in its entirety for all useful purposes which states that removal rate is proportional to the product of polishing down-force and relative velocity between wafer and pad. For synchronous rotation of wafer and pad, all points on the wafer surface experience the same relative velocity. However, in reality, synchronous rotation is seldom used and wafer and pad rotational speeds will differ. This can result in non-uniformity in removal rate across the wafer surface producing either center slow or center fast polishing.

The problem can be rectified by varying groove density across the pad surface, in other words, by changing either groove width, pitch or depth from the center to the edge of the pad. By changing groove depth (i.e. GSQ) or the groove configuration (circular versus X-Y versus both, etc.) the local stiffness of the pad can be controlled, and by changing groove versus land area (i.e. GFQ) the slurry distribution and area of the pad in contact with the wafer can be manipulated.

An example of when such control would be useful is in the case of non-uniform metallization of semiconductor wafers. The thickness of electroplated copper deposited on wafers is frequently non-uniform across the wafer because of poor control of the plating process. In order to achieve a planar copper thickness after polishing, it is desirable to have a pad which can preferentially remove copper faster in the thicker areas. This can be accomplished by making the pad stiffer (i.e. decreasing GSQ) or by increasing slurry flow to those areas (i.e. increasing GFQ).

The pads of the present invention can be made in any one of a number of different ways. Indeed, the exact composition generally is not important so long as the pads exhibit low elastic recovery during polishing. Although urethanes are a preferred pad material, the present invention is not limited to polyurethanes and can comprise virtually any chemistry capable of providing the low elastic recovery described herein. The pads can be, but are not limited to, thermoplastics or thermosets and can also be filled or unfilled. The pads of the present invention can be made by any one of a number of polymer processing methods, such as but not limited to, casting, compression, injection molding (including reaction injection molding), extruding, web-coating, photopolymerizing, printing (including ink-jet and screen printing), sintering, and the like.

In a preferred embodiment, the pads of the present invention have one or more of the following attributes:

1. Reduced pad surface glazing requiring less aggressive conditioning, resulting in low pad wear and long pad life;
2. Minimal dishing of conductive features such as conductors and plugs;
3. Die-level planarity achieved across the wafer surface; and/or
4. Minimal defects such as scratches and light-point-defects leading to improved electrical performance of the polished semiconductor device.

The above attributes can be influenced and sometimes controlled through the physical properties of the polishing pad, although pad performance is also dependent on all aspects of the polishing process and the interactions between pad, slurry, polishing tool, and polishing conditions, etc.

In one embodiment, the pads of the present invention define a polishing surface which is smooth, while still maintaining micro-channels for slurry flow and nano-asperities to promote polishing. One way to minimize pad roughness is to construct an unfilled pad, since filler particles tend to increase pad roughness.

Pad conditioning can also be important. Sufficient conditioning is generally required to create micro-channels in the pad surface and to increase the hydrophilicity of the pad surface, but over-conditioning can roughen the surface excessively, which in turn can lead to an increase in unwanted dishing.

The pads of the present invention preferably have low elastic rebound. Such rebound can often be quantified by any one of several metrics. Perhaps the simplest such metric involves the application of a static compressive load and the measurement of the percent compressibility and the percent elastic recovery. Percent compressibility is defined as the compressive deformation of the material under a given load, expressed as a percentage of the pad's original thickness. Percent elastic recovery is defined as the fraction of the compressive deformation that recovers when the load is removed from the pad surface.

However, the above test for elastic rebound may be flawed, since polishing is a dynamic process and may not be adequately defined using static parameters. Also, polishing pads tend to be polymeric exhibiting viscoelastic behavior; therefore, perhaps a better method of characterization is to use the techniques of dynamic mechanical analysis (see J. D. Ferry, "Viscoelastic Properties of Polymers", New York, Wiley, 1961 which is hereby incorporated by reference in its entirety for all useful purposes).

Viscoelastic materials exhibit both viscous and elastic behavior in response to an applied deformation. The resulting stress signal can be separated into two components: an elastic stress which is in phase with the strain, and a viscous stress which is in phase with the strain rate but 90 degrees out of phase with the strain. The elastic stress is a measure of the degree to which a material behaves as an elastic solid; the viscous stress measures the degree to which the material behaves as an ideal fluid. The elastic and viscous stresses are related to material properties through the ratio of stress to strain (this ratio can be defined as the modulus). Thus, the ratio of elastic stress to strain is the storage (or elastic) modulus and the ratio of the viscous stress to strain is the loss (or viscous) modulus. When testing is done in tension or compression, E' and E" designate the storage and loss modulus, respectively.

The ratio of the loss modulus to the storage modulus is the tangent of the phase angle shift (δ) between the stress and the strain. Thus, $$E''/E' = \tan\delta$$

and is a measure of the damping ability of the material.

Polishing is a dynamic process involving cyclic motion of both the polishing pad and the wafer. Energy is generally transmitted to the pad during the polishing cycle. A portion of this energy is dissipated inside the pad as heat, and the remaining portion of this energy is stored in the pad and subsequently released as elastic energy during the polishing cycle. The latter is believed to contribute to the phenomenon of dishing.

It has been discovered that pads which have relatively low rebound and which absorb the relatively high amounts of energy during cyclic deformation tend to cause relatively low amounts of dishing during polishing. There are several parameters which may be used to describe this effect quantitatively. The simplest is Tan δ, defined above. However, perhaps a better parameter for predicting polishing performance is known as the "Energy Loss Factor". ASTM D4092-90 "Standard Terminology Relating to Dynamic Mechanical Measurements of Plastics" which is incorporated by reference in its entirety for all useful purposes) defines this parameter as the energy per unit volume lost in each deformation cycle. In other words, it is a measure of the area within the stress-strain hysteresis loop.

The Energy Loss Factor (KEL) is a function of both tan δ and the elastic storage modulus (E') and may be defined by the following equation:

$$KEL=\tan\delta*10^{12}/[E'*(1+\tan\delta^2)]$$

where E' is in Pascals.

The higher the value of KEL for a pad, generally the lower the elastic rebound and the lower the observed dishing.

One method to increase the KEL value for a pad is to make it softer. However, along with increasing the KEL of the pad, this method tends to also reduce the stiffness of the pad. This can reduce the pad's planarization efficiency which is generally undesirable. A preferred approach to increase a pad's KEL value is to alter its physical composition in such a way that KEL is increased without reducing stiffness. This can be achieved by altering the composition of the hard segments (or phases) and the soft segments (or phases) in the pad and/or the ratio of the hard to soft segments (or phases) in the pad. This results in a preferred pad that has a suitably high hardness with an acceptably high stiffness to thereby deliver excellent planarization efficiency.

The morphology of a polymer blend can dictate its final properties and thus can affect the end-use performance of the polymer in different applications. The polymer morphology can be affected by the manufacturing process and the properties of the ingredients used to prepare the polymer. The components of the polymer used to make the polishing pad should preferably be chosen so that the resulting pad morphology is stable and easily reproducible.

In another embodiment of this invention, the glass transition temperature of the polymer used to make the polishing pad is shifted to sub-ambient temperatures without impacting the stiffness of the pad appreciably. Lowering the glass transition temperature (Tg) of the pad increases the KEL of the pad and also creates a pad whose stiffness changes very little between the normal polishing temperature range of 20° C. and 100° C. Thus changes in polishing temperature have minimal effect on pad physical properties, especially stiffness. This can result in more predictable and consistent performance.

A feature of one embodiment of this invention is the ability to shift the glass transition temperature to below room temperature and to design a formulation which results in the modulus above Tg being constant with increasing temperature and of sufficiently high value to achieve polishing planarity. Modulus consistency can often be improved through either crosslinking, phase separation of a "hard", higher softening temperature phase, or by the addition of inorganic fillers (alumina, silica, ceria, calcium carbonate, etc.). Another advantage of shifting the Tg (glass transition temperature) of the polymer to sub-ambient temperatures is that in some embodiments of the invention, the resulting pad surface can be more resistant to glazing.

For high performance polishing of semiconductor substrates, it has been discovered that consistent groove performance requires that the polishing surface between pad grooves is a hydrophilic porous or non-porous material which is not supported or otherwise reinforced by a non-woven fiber-based material.

Pads of the present invention can be made by any one of a number of polymer processing methods, such as but not limited to, casting, compression, injection molding (including reaction injection molding), extruding, web-coating, photopolymerizing, extruding, printing (including ink-jet and screen printing), sintering, and the like. The pads may also be unfilled or optionally filled with materials such as polymeric microballoons, gases, fluids or inorganic fillers such as silica, alumina and calcium carbonate. Preferred abrasive particles include, but are not limited to, alumina, ceria, silica, titania, germanium, diamond, silicon carbide or mixtures thereof. Pads of the present invention can be designed to be useful for both conventional rotary and for next generation linear polishers (roll or belt pads).

Additionally, pads of the present invention can be designed to be used for polishing with conventional abrasive containing slurries, or alternatively, the abrasive may be incorporated into the pad and the pad used with a particle free reactive liquid, or in yet another embodiment, a pad of the present invention without any added abrasives may be used with a particle free reactive liquid (this combination is particularly useful for polishing materials such as copper). Preferred abrasive particles include, but are not limited to, alumina, ceria, silica, titania, germania, diamond, silicon carbide or mixtures thereof. The reactive liquid may also contain oxidizers, chemicals enhancing metal solubility (chelating agents or complexing agents), and surfactants. Slurries containing abrasives also have additives such as organic polymers which keep the abrasive particles in suspension. Complexing agents used in abrasive-free slurries typically comprise two or more polar moieties and have average molecular weights greater than 1000.

The pads of this invention also have a small portion constructed of a polymer that is transparent to electromagnetic radiation with a wavelength of about 190 to about 3,500 nanometers. This portion allows for optical detection of the wafer surface condition as the wafer is being polished. More detail may be found in U.S. Pat. No. 5,605,760 which is incorporated here in all its entirety for all useful purposes. Potential attributes of the pad of the present invention include:

1. High pad stiffness and pad surface hardness;
2. High energy dissipation (high KEL);
3. Stable morphology that can be reproduced easily and consistently, and which does not change significantly or adversely during polishing;
4. Pad surface that reduces glazing, thereby requiring less frequent and less aggressive conditioning, resulting in low pad wear during polishing and long pad life;
5. No porosity and surface voids thereby reducing pockets that trap used slurry and increase pad roughness, thereby eliminating a major source of defects in wafers;
6. Improved slurry distribution and waste removal preventing hydroplaning of the wafer being polished, leading to minimal defects on the wafer surface; and/or
7. Pad chemistry can be easily altered to make it suitable for polishing a wide variety of wafers.

One or more of the above features can often translate into the following polishing benefits:

1. The high pad stiffness yields wafers that have good planarity;
2. The pad's top layer conditions more easily and uniformly with low glazing, and this reduces scratches and LPD defects on polished IC wafers when compared to other pads;
3. Lower final dishing is seen on pattern wafers even at extended overpolish times. This is attributable to the favorable combination of high KEL and high modulus;

4. Larger polish window on pattern wafers when compared to standard pads;
5. No feature specific dishing observed on pattern wafers; and/or
6. Pad stiffness changes very little between the normal polishing temperature range of 20° C. and 100° C. leading to a very stable and uniform polishing.

In summary:

1. Preferred pads for metal CMP generally have an optimized combination of one or more of the following: stiffness (modulus and thickness), groove design (impacting groove width, groove depth, and groove pitch), Groove Stiffness Quotient, Groove Flow Quotient, Energy Loss Factor (KEL), modulus-temperature ratio, hardness, and surface roughness: by varying the pad composition, these can be somewhat independently controlled;
2. Pads with low elastic recovery generally produce low dishing of features during metal CMP polishing;
3. Low elastic recovery can be defined in terms of the "Energy Loss Factor" (KEL);
4. Preferred ranges for these parameters are shown below:

| Parameter | Range | Preferred Range | Most Preferred |
|---|---|---|---|
| Thickness (micrometers) | 250–5,100 | 1,270–5,100 | 2,000–3,600 |
| Surface Roughness, Ra ($\mu$) | 1–9 | 2–7 | 3–5 |
| Hardness (Shore D) | 40–70 | 45–65 | 55–63 |
| Groove Depth (micrometers) | 75–2,540 | 375–1,270 | 635–890 |
| Groove Width (micrometers) | 125–1,270 | 250–760 | 375–635 |
| Groove Pitch (micrometers) | 500–3,600 | 760–2,280 | 2,000–2,260 |
| GSQ | 0.03–1.00 | 0.1–0.7 | 0.2–0.4 |
| GFQ | 0.03–0.9 | 0.1–0.4 | 0.2–0.3 |
| Modulus, E' (MPa) (40° C.) | 150–2000 | 150–1500 | 200–800 |
| KEL(1/Pa)(40° C.) | 100–1000 | 125–850 | 150–400 |
| Ratio of E' at 30° C. and 90° C. | 1.0–4.6 | 1.0–4.0 | 1.0–3.5 |

Notes:

Modulus, (E') and Energy Loss Factor (KEL) are measured using the method of Dynamic Mechanical Analysis at a temperature of 40° C. and frequency of 10 radians/sec. KEL is calculated using the equation defined earlier.

The last row defines the ratio of the modulus measured at 30° C. and 90° C. This represents the useful temperature range for polishing. Ideally, modulus will change as little as possible and in a linear trend with increasing temperature (i.e. ratio approaches unity). Surface roughness values are after conditioning.

From the above table, it is apparent that preferred pads of this invention will generally have a flat modulus—temperature response, a high KEL value in combination with a high modulus value, low surface roughness after conditioning, and optimized GSQ and GFQ values corresponding to the groove design chosen for a specific polishing application.

EXAMPLE

While there is shown and described certain specific structures embodying the invention, it will be manifest to those skilled in the art that various modifications and rearrangements of the parts may be made without departing from the spirit and scope of the underlying inventive concept and that the same is not limited to the particular forms herein shown and described. The following, non-limiting examples illustrate the benefits of the present invention. Examples 1 and 2 represent comparative prior art pads.

Comparative Example 1 (Prior Art)

This example refers to prior art pads disclosed in U.S. Pat. Nos. 5,578,362 and 5,900,164. A polymeric matrix was prepared by mixing 2997 grams of polyether-based liquid urethane (Uniroyal ADIPRENE® L325) with 768 grams of 4,4-methylene-bis-chloroaniline (MBCA) at about 65° C. At this temperature, the urethane/polyfunctional amine mixture has a pot life of about 2.5 minutes; during this time, about 69 grams of hollow elastic polymeric microspheres (EXPANCEL® 551DE) were blended at 3450 rpm using a high shear mixer to evenly distribute the microspheres in the mixture. The final mixture was transferred to a mold and permitted to gel for about 15 minutes.

The mold was then placed in a curing oven and cured for about 5 hours at about 93° C. The mixture was then cooled for about 4–6 hours, until the mold temperature was about 21° C. The molded article was then "skived" into thin sheets and macro-channels mechanically machined into the surface ("Pad 1A").

Similarly, another filled pad ("Pad 1C"), was made in an analogous manner with the exception that ADIPRENE® L325 was replaced with a stoichiometrically equivalent amount of ADIPRENE® L100.

A third pad ("Pad 1B") was made by the same manufacturing process as described above but the polyurethane was unfilled.

Comparative Example 2 (Prior Art)

This example refers to a pad ("Pad 2A") made by a molding process disclosed in U.S. Pat. No. 6,022,268.

In order to form the polishing pad, two liquid streams were mixed together and injected into a closed mold, having the shape of the required pad. The surface of the mold is typically grooved so that the resulting molded pad also has a grooved macro-texture to facilitate slurry transport. The first stream comprised a mixture of a polymeric diol and a polymeric diamine, together with an amine catalyst. The second stream comprised diphenylmethanediisocyanate (MDI). The amount of diisocyanate used was such as to give a slight excess after complete reaction with diol and diamine groups.

The mixed streams were injected into a heated mold at about 70° C. to form a phase separated polyurethane-urea polymeric material. After the required polymerization time had elapsed, the now solid part, in the form of a net-shape pad, was subsequently demolded.

Table 1 shows key physical properties for the pads described in Examples 1 and 2:

TABLE 1

Physical Properties of Pad 1A, Pad 1B, Pad 1C, Pad 2A

| Parameter | Pad 1A | Pad 1B | Pad 1C | Pad 2A |
|---|---|---|---|---|
| Example # | 1A | 1B | 1C | 2 |
| Surface Roughness, Ra ($\mu$) | 10–14 | 2–5 | Similar IC1000 | 1–4 |
| Hardness (Shore D) | 50–55 | 73 | 29 | 60–65 |
| Modulus (MPa) (40° C.) | 370 | 926 | 26 | 1580 |
| KEL (l/Pa) (40° C.) | 243 | 108 | 766 | 33 |
| Ratio of E' at 30° C. and 90° C. | 5.2 | 6.4 | 7.5 | 11.8 |

Example 3

Example 3 illustrates the making of filled and unfilled pads, in accordance with the present invention, using a casting process analogous to that described in Example 1.

le;3qUnfilled castings (Examples 3A, B and C) were prepared using the isocyanate ADIPRENES shown in Table 2 cured with 95% of the theoretical amount of MBCA curing agent. Preparation consisted of thoroughly mixing together ADIPRENE and MBCA ingredients and pouring the intimate mixture into a circular mold to form a casting. Mold temperature was 100° C. and the castings were subsequently post-cured for 16 hours at 100° C. After post-curing, the circular castings were "skived" into thin 50 mil thick sheets and macro-channels were mechanically machined into the surface. Channels were typically 15 mil deep, 10 mil wide, with a pitch of 30 mil. Properties of the castings are shown in Table 2 and illustrate the favorable combination of key physical properties required for improved polishing of metal layers in a CMP process:

Example 3D contains 2 wt % EXPANCEL® 551DE and is made as described in Example 1.

TABLE 2

Properties of Cast Pads

| Example # | 3A | 3B | 3C | 3D |
|---|---|---|---|---|
| Type | Unfilled | Unfilled | Unfilled | Filled |
| ADIPRENE ® (1) | LF1950A | LF950A | LF700D | LF751D |
| EXPANCEL ® 551DE | 0 | 0 | 0 | 2 wt % |
| Hardness (Shore D) | 40 | 50 | 70 | 59 |
| Modulus (MPa) (40° C.) | 120 | 122 | 533 | 452 |
| KEL (1/Pa) (40° C.) | 714 | 666 | 285 | 121 |
| Ratio of E' at 30° C. and 90° C. | 1.3 | 1.1 | 2.5 | 2.7 |

(Note 1: ADIPRENE ® LF products are Toluene Diisocyanate based prepolymers manufactured by Uniroyal Chemical Company Inc.)

Example 4

Example 4 illustrates making pads of the present invention using a molding process analogous to that described in Example 2. Table 3 shows the composition and key physical properties of typical pads made by a molding process. Molding conditions are as described in Example 2.

TABLE 3

Composition and Properties of Molded Pads

| Composition | Examples 4A | 4B | 4C | 4D |
|---|---|---|---|---|
| Polyamine (Eq. Wt. 425) | 24.71 | 18.42 | 18.43 | 34.84 |
| Polyamine (Eq. Wt. 220) | 24.71 | 30.05 | 30.56 | 24.39 |
| Polypropylene Glycol (Eq. Wt. 1000) | 21.18 | 20.77 | | |
| Polypropylene Glycol (Eq. Wt. 2100) | | | 21.12 | 10.45 |
| MDI (Eq. Wt. 144.5) | 29.39 | 30.77 | 29.59 | 30.33 |
| Hardness (Shore D) | 52 | 51 | 57 | 60 |
| Modulus (MPa) (40° C.) | 196 | 214 | 657 | 690 |
| KEL (l/Pa) (40° C.) | 517 | 418 | 208 | 199 |
| Ratio of E' at 30° C. and 90° C. | 4.6 | 4.1 | 4.2 | 3.4 |
| Normalized Copper Removal Rate | 0.713 | 0.648 | 0.616 | 0.919 |

(Numbers refer to weight percent of each component)

A typical pad formulation from Table 3 was used to polish copper patterned wafers in order to measure dishing of fine copper features. Polishing performance was compared to that of a pad as prepared in Example 1.

Both pads were polished using an Applied Materials' MIRRA polisher using a platen speed of 141 rpm, a carrier speed of 139 rpm, and a down-force of 4 psi. The pads were both preconditioned before use with an ABT conditioner. Post conditioning was used between wafers. Sematech pattern wafer 931 test masks containing copper features of different dimensions were polished using the pads in conjunction with an experimental copper slurry (CUS3116) from Rodel.

After polishing, the copper features were measured for dishing using atomic force microscopy. Defects were measured using an Orbot Instruments Ltd. wafer inspection system. Table 4 summarizes dishing and defect data for the pads polished.

TABLE 4

Patterned Wafer Polishing Data for Molded Pad

| Pad Type | Dishing (A) versus Feature Size and Type: 10$\mu$ Line | 25$\mu$ Line | 100$\mu$ Line | Bond Pad | No. of Defects |
|---|---|---|---|---|---|
| Control | 1037 | 1589 | 2197 | 2009 | 14760 |
| Molded Pad | 455 | 589 | 775 | 392 | 265 |

It is clearly apparent from the data that the molded pad significantly reduces dishing and defectivity.

Example 5

Example 5 illustrates making pads of the present invention from thermoplastic polymers using an extrusion process. A polyether type thermoplastic polyurethane was blended with 20 wt % of either 4 micron or 10 micron calcium carbonate filler using a Haake mixer. The resulting blend, together with the unfilled polymer, was extruded into a 50 mil sheet using a twin-screw extruder manufactured by American Leistritz. Additional formulations were prepared by blending together the above polyether based TPU with a softer polyester based TPU. These were again filled with calcium carbonate. The key physical properties of the sheets were measured and are shown in Table 5:

TABLE 5

Composition and Properties of Extruded Pads

| Composition | Examples 5A | 5B | 5C | 5D | 5E | 5F |
|---|---|---|---|---|---|---|
| Polyether based TPU (nominal hardness 65D) (wt %) | 100 | 80 | 80 | 75 | 60 | 60 |
| Polyester based TPU (nominal hardness 45D) (wt %) | — | | | 25 | 20 | 20 |
| 4 micron Calcium Carbonate (wt %) | — | 20 | | | 20 | |
| 10 micron Calcium Carbonate (wt %) | — | | 20 | | | 20 |
| Modulus (MPa) (40° C.) | 204 | 567 | 299 | 416 | 309 | 452 |
| KEL (1/Pa) (40° C.) | 547 | 167 | 394 | 168 | 269 | 170 |
| Ratio of E' at 30° C. and 90° C. | 2.4 | 1.7 | 2.2 | 1.6 | 1.8 | 1.6 |

Although thermoplastic polyurethane (TPU's) examples are used to illustrate the invention, the invention is not limited to TPU's. Other thermoplastic or thermoset polymers such as nylons, polyesters, polycarbonates, polymethacrylates, etc. are also applicable, so long as the key property criteria are achieved. Even if not achievable by an unfilled thermoplastic polymer, the properties may be realized by modifying the base polymer properties by filling with organic or inorganic fillers or reinforcements, blending with other polymers, copolymerization, plasticization, or by other formulation techniques known to those skilled in the art of polymer formulation.

A typical pad formulation from Table 5 was used to polish copper patterned wafers in order to measure dishing of fine copper features. Polishing performance was compared to that of a pad as prepared in Example 1.

Both pads were polished using an Applied Materials' MIRRA polisher using a platen speed of 141 rpm, a carrier speed of 139 rpm, and a down-force of 4 psi. The pads were both preconditioned before use using an ABT conditioner. Post conditioning was used between wafers. Sematech pattern wafer 931 test masks containing copper features of different dimensions were polished using the pads in conjunction with slurry.

After polishing, the copper features were measured for dishing using atomic force microscopy. Defects were measured using an Orbot Instruments Ltd. wafer inspection system. Table 6 summarizes dishing and defect data for the pads polished.

TABLE 6

Patterned Wafer Polishing Data for Extruded Pad

| Pad Type | Dishing (A) versus Feature Size and Type 10μ Line | 25μ Line | 100μ Line | Bond Pad |
|---|---|---|---|---|
| Control | 1037 | 1589 | 2197 | 2009 |
| Extruded Pad | 750 | 923 | 1338 | 641 |

It is clearly apparent from the data that the extruded pad significantly reduces dishing.

Example 6

Figure 2:
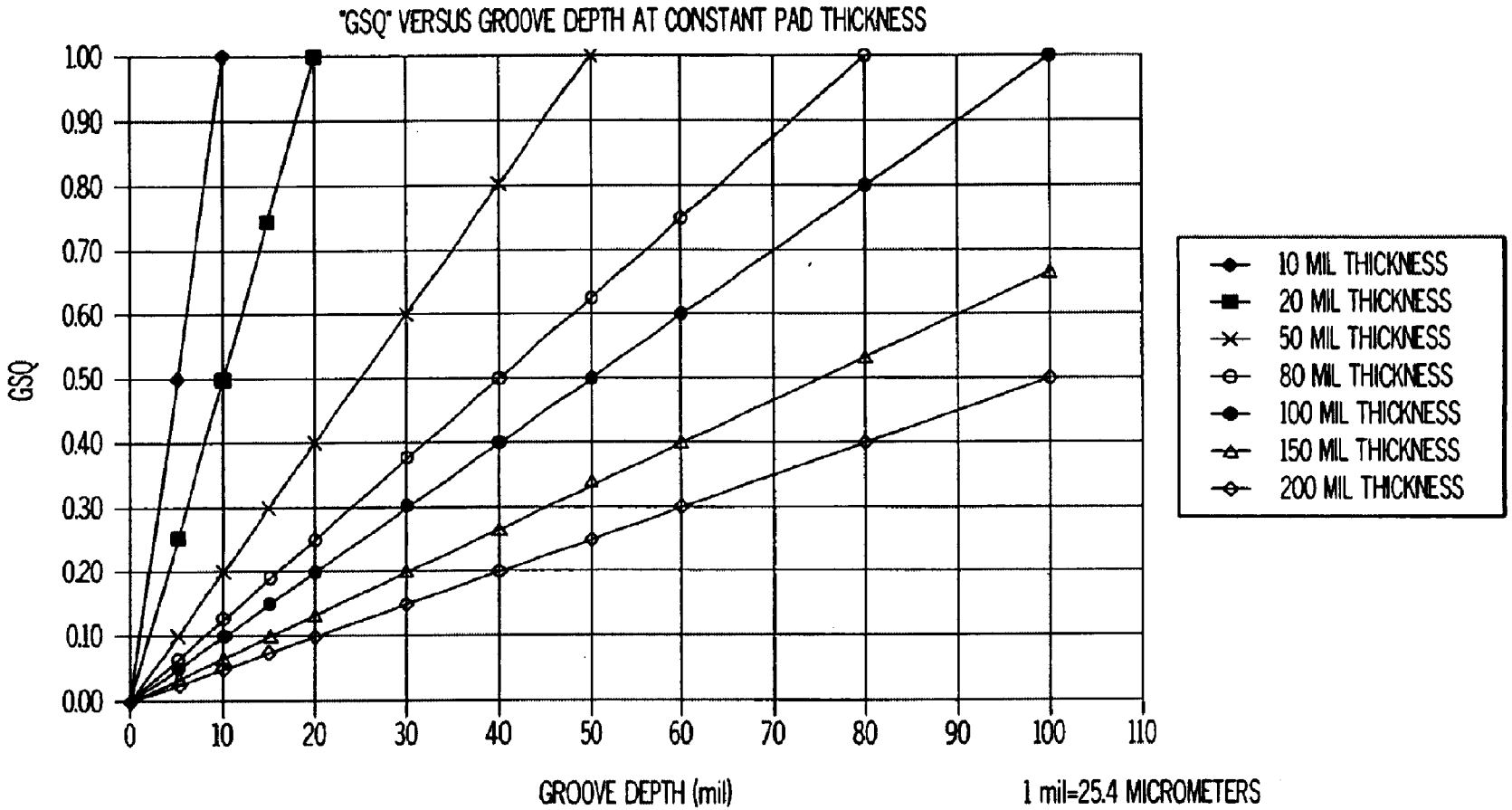
FIG. 2 illustrates GSQ versus Groove Depth at constant Pad Thicknesses.
Figure 3:
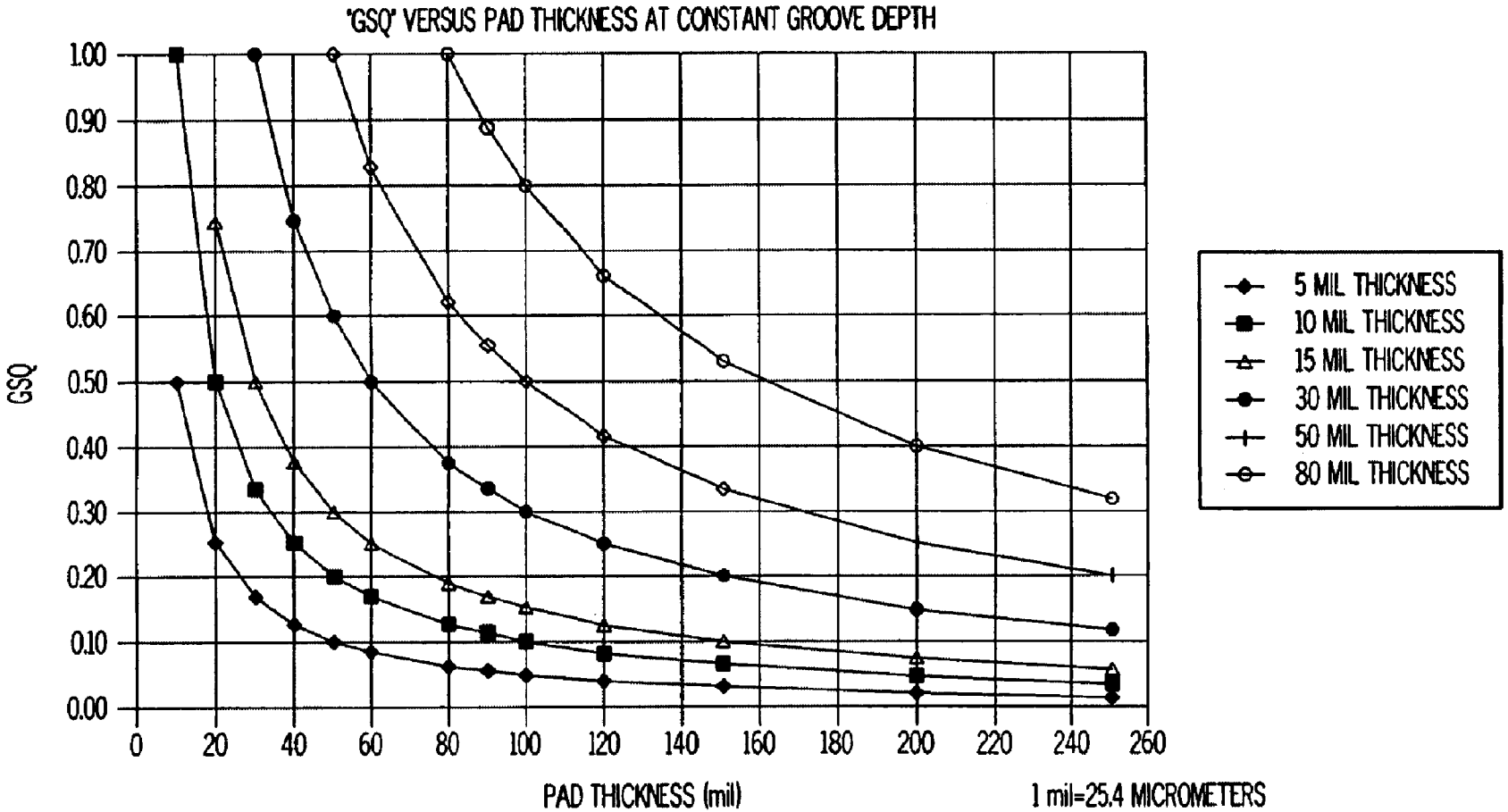
FIG. 3 illustrates GSQ versus Pad Thickness at constant Groove Depths.
Figure 4:
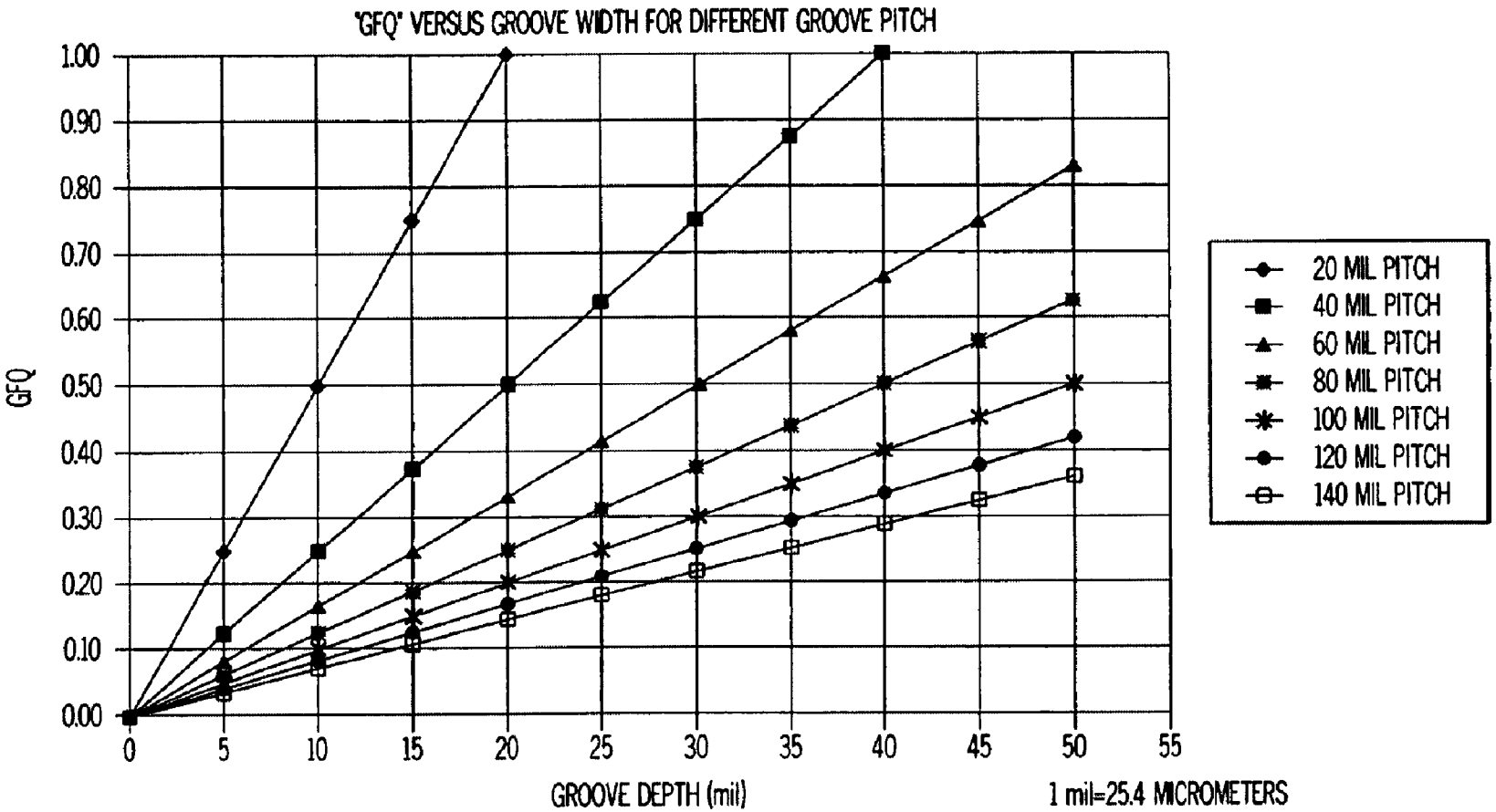
FIG. 4 illustrates GFQ versus Groove Width at constant Groove Pitches.
Figure 5:
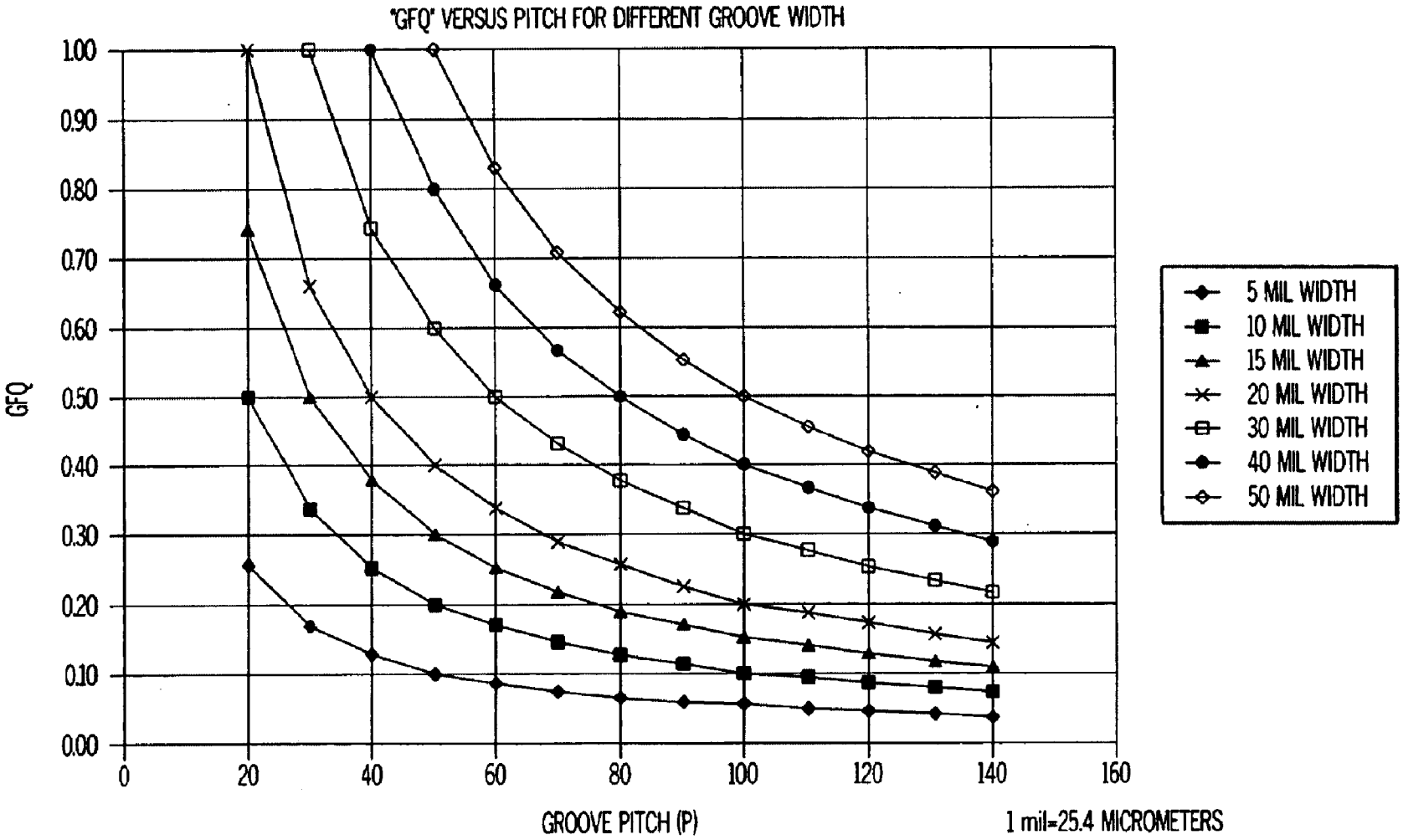
FIG. 5 illustrates GFQ versus Groove Pitch at constant Groove Widths.

FIGS. 2 through 5 graphically show the relationships between GSQ and GFQ ratios and groove dimensions for the pad of this invention. FIGS. 2 and 3 show preferred ranges for Groove Depth and Pad Thickness respectively. From these values of Groove Depth and Pad Thickness, it is possible to calculate preferred ranges for GSQ. Likewise, FIGS. 4 and 5 show preferred ranges for Groove Width and Groove Pitch respectively. From these values of Groove Width and Groove Pitch, it is possible to calculate preferred ranges for GFQ. The Table below summarizes the ranges of groove dimensions and specific values for an "optimized" pad:

| Parameter | Range | Preferred Range | Most Preferred | Optimum |
|---|---|---|---|---|
| Thickness (micrometers) | 250–5,100 | 1,270–5,100 | 2,000–3,600 | 2,300 |
| Groove Depth (micrometers) | 75–2,540 | 375–1,270 | 635–890 | 760 |
| Groove Width (micrometers) | 125–1,270 | 250–760 | 375–635 | 500 |
| Groove Pitch (micrometers) | 500–3,600 | 760–2,280 | 2,000–2,260 | 2,150 |
| GSQ | 0.03–1.00 | 0.1–0.7 | 0.2–0.4 | 0.333 |
| GFQ | 0.03–0.9 | 0.1–0.4 | 0.2–0.3 | 0.235 |

Further a polishing pad's groove design may be optimized to achieve optimal polishing results. This optimization may be achieved by varying the groove design across the pad surface to tune the slurry flow across the pad-wafer interface during CMP polishing.

For example, if a higher removal rate at the center of the wafer is desired, two different techniques are available to accomplish this objective. The number of grooves at the center of the wafer track on the pad may be reduced while increasing or maintaining the number of grooves elsewhere on the pad. This increases the pad area in contact with the center of the wafer and helps to increase the removal rate at the center of the wafer.

Another technique to increase the removal rate at the center of the wafer is to reduce the groove depth at the center of the wafer track on the pad. This is especially effective when polishing copper substrates using an abrasive containing slurry. These shallow grooves increase the amount of abrasive trapped between the wafer surface and the pad thereby increasing the removal rate at the center of the wafer.

The groove design may also be utilized to change the residence time of the slurry across the wafer surface. For example, the residence time of the slurry at the pad-wafer interface may be increased by increasing the groove depth uniformly across the pad.

Similarly, the residence time of the slurry at the pad-wafer interface may be reduced by changing the groove pattern on the pad. An X-Y pattern may be superimposed on top of a circular pattern to channel slurry quickly across the wafer surface. Further the pitch of the circular grooves or the X-Y grooves may be altered to adjust the slurry flow across the pad surface.

Example 7

The attached Table shows changes in pad properties after immersion in deionized water at room temperature (25° C.) for 24 hours.

Change in Pad Properties after Immersion in Water

| | Example 4D | | | Example 5A | | | Example 3C | | |
|---|---|---|---|---|---|---|---|---|---|
| Parameter | Dry | Wet | % Change | Dry | Wet | % Change | Dry | Wet | % Change |
| Swelling (mm)[a] | 22.61 | 22.66 | 0.2 | 22.61 | 22.66 | 0.2 | 22.61 | 22.71 | 0.4 |
| Hardness (Shore D) | 58.5 | 44.7 | −23.6 | 48.2 | 42.7 | −11.4 | 65.6 | 60.0 | −8.5 |
| Modulus, E' (MPa) (40° C.) | 690 | 568 | −17.7 | 232 | 164 | −29.3 | 510 | 344 | −32.5 |
| KEL (1/Pa) (40° C.) | 181 | 240 | 32.7 | 620 | 622 | 0.4 | 261 | 360 | 37.8 |
| Ratio of E' at 30° C. and 90° C. | 2.35 | 2.16 | −7.9 | 2.52 | 2.14 | −14.8 | 2.19 | 1.41 | −35.6 |

[a]Change in linear dimension after immersion in deionized water for 24 hours at room temperature (25° C.).

The above pads are hydrolytically stable, because any linear dimension of the pads changes by less than about 1%, after immersion in deionized water for 24 hours at room temperature (25° C.). In alternative embodiments, hydrolytic stability is defined as "the hardness of the pads will decrease by less than 30%, after immersion in deionized water for 24 hours at room temperature (25° C.)."

For hydrolytically stable grooved pads in accordance with the present invention, the pad properties have the following ranges:

| Parameter | Range | Preferred Range | Most Preferred |
|---|---|---|---|
| Thickness (micrometers) | 250–5,100 | 1,270–3,600 | 2,300 |
| Surface Roughness, Ra ($\mu$) | 1–9 | 2–7 | 3–5 |
| % Change in Swelling[a] | 0–1 | 0.2–0.8 | 0.2–0.4 |
| Hardness (Shore D) | 40–70 | 45–65 | 55–63 |
| % Decrease in Hardness | 0–30 | 0–25 | 0–10 |
| Modulus, E' (MPa) (40° C.) | 100–2000 | 150–1500 | 200–800 |
| KEL(1/Pa) (40° C.) | 100–1000 | 125–850 | 150–400 |
| Ratio of E' at 30° C. and 90° C. | 1.0–4.6 | 1.0–4.0 | 1.0–3.5 |
| Groove Depth (micrometers) | 75–2,540 | 375–1,270 | 635–890 |
| Groove Width (micrometers) | 125–1,270 | 250–760 | 375–635 |
| Groove Pitch (micrometers) | 500–3,600 | 760–2,280 | 2,000–2,260 |
| GSQ | 0.03–1.00 | 0.1–0.7 | 0.2–0.4 |
| GFQ | 0.03–0.9 | 0.1–0.4 | 0.2–0.3 |

[a]Change in linear dimension after immersion in deionized water for 24 hours at room temperature (25° C.).

For hydrolytically stable pads, after immersion in deionized water for 24 hours at room temperature (25° C.), properties still fall within the above ranges.

What is claimed is:

1. A hydrolytically stable polishing pad useful for planarizing a surface of a semiconductor wafer; the pad comprising:

a polishing layer for planarizing the surface, wherein the polishing layer has the following:

i. a thickness of about 250 to 5,100 micrometers;

ii. a hardness of about 40–70 Shore D;

iii. a tensile Modulus of about 100–2,000 MPa at 40° C.;

iv. an Energy Loss Factor, KEL, of about 100–1,000 (1/Pa at 40° C.); and v. an Elastic Storage Modulus, E', ratio at 30° C. and 90° C. of about 1–5;

the polishing layer having a macro-texture comprising a groove pattern having one or more grooves; the groove pattern having:

i. a groove depth of about 75 to about 2,540 micrometers;

ii. a groove width of about 125 to about 1,270 micrometers; and iii. a groove pitch of about 500 to 3,600 micrometers;

the groove pattern being from the group consisting of random, concentric, spiral, cross-hatched, X-Y grid, hexagonal, triangular, fractal and combinations thereof.

2. The hydrolytically stable pad according to claim 1 wherein any linear dimension of the pad changes by less than about 1% when the pad is immersed in deionized water for 24 hours at an ambient temperature of about 25° C.

3. The polishing pad according to claim 2 wherein the groove pattern has the following:

i. the groove depth of about 375 to about 1,270 micrometers;

ii. the groove width of about 250 to about 760 micrometers; and iii. the groove pitch of about 760 to 2,280 micrometers.

4. The polishing pad according to claim 2 wherein the groove pattern has the following:

i. the groove depth of about 635 to about 890 micrometers;

ii. the groove width of about 375 to about 635 micrometers; and iii. the groove pitch of about 2,000 to 2,260 micrometers.

5. The polishing pad in accordance with claim 2 wherein the groove pattern provides:

i. a groove stiffness quotient, GSQ, of about 0.03 to about 1.0; and ii. a groove flow quotient, GFQ, of about 0.03 to about 0.9.

6. The polishing pad in accordance with claim 5 wherein the polishing layer is further defined as having a micro-texture comprising a plurality of asperities with an average protrusion length of less than 0.5 micrometers.

7. The polishing pad in accordance with claim 5 wherein the pad is an elongated sheet, a belt or a disk.

8. The polishing pad in accordance with claim 5 wherein the pad has at least one non-polishing layer.

9. The polishing pad in accordance with claim 5 wherein the polishing layer is a polymer selected from a group consisting of thermoplastic and thermoset polymers.

10. The polishing pad in accordance with claim 5 wherein the polishing layer includes a polyurethane selected from a group consisting of polyether or polyester urethanes.

11. The polishing pad in accordance with claim 5 wherein the polishing layer is non-porous.

12. The polishing pad in accordance with claim 5 wherein the polishing layer is porous.

13. The polishing pad in accordance with claim 5 wherein the polishing layer includes a filler.

14. The polishing pad in accordance with claim 5 wherein the polishing layer is de-void of a filler.

15. The polishing pad in accordance with claim 5 wherein the polishing layer has abrasive particles selected from a group consisting of alumina, ceria, silica, titania, germania, diamond and silicon carbide.

16. The polishing pad in accordance with claim 5 wherein the pad has a belt configuration and the pad is a thermoplastic polyurethane.

17. The polishing pad in accordance with claim 5 wherein the pad has a molded belt configuration.

18. The polishing pad in accordance with claim 5 wherein the polishing layer is de-void of abrasive particles.

19. The polishing pad in accordance with claim 5 wherein the pad is formed by a method selected from the group consisting of casting, compression, injection molding, reaction injection molding, extruding, web coating, photopolymerizing, ink-jet printing, screen printing, sintering and the like.

20. The polishing pad in accordance with claim 5 wherein at least a portion of the pad is transparent to electromagnetic radiation having a wavelength of from about 190 to about 3500 nanometers.

21. The polishing pad in accordance with claim 5, wherein the land area of the grooves on the pad has an average surface roughness of about 1 to about 9 micrometers.

22. The polishing pad in accordance with claim 21 wherein the ratio of Elastic Storage Modulus, E', at 30° C. and 90° C. is from about 1 to about 3.5.

23. The polishing pad in accordance with claim 5 wherein the Energy Loss Factor, KEL, is in the range of about 125–850 (1/Pa at 40° C.).

24. The polishing pad in accordance with claim 5 wherein the ratio of Elastic Storage Modulus, E', at 30° C. and 90° C. is in the range of about 1 to about 4.

25. The polishing pad in accordance with claim 5 wherein the polishing layer has the following:

i. land area of grooves with an average surface roughness of 2–7 micrometers;

ii. hardness of about 45–65 Shore D;

iii. tensile modulus of about 150–1,500 MPa at 40° C.;

iv. KEL of about 125–850 (1/Pa at 40° C.); and v. E' ratio at 30° C. and 90° C. of about 1.0–4.0.

26. The polishing pad in accordance with claim 5 wherein the polishing layer has the following:

i. land area of grooves with an average surface roughness of 3–5 micrometers;

ii. hardness of about 55–63 Shore D;

iii. tensile modulus of about 200–800 MPa at 40° C.;

iv. KEL of about 150–400 (1/Pa at 40° C.); and v. E' ratio at 30° C. and 90° C. of about 1.0–3.5.

27. The polishing pad in accordance with claim 5 wherein the surface for planarizing is a metal selected from a group consisting of copper, a tungsten and aluminum.

28. The polishing pad in accordance with claim 5 wherein the polishing surface has an average surface roughness of about 1 to about 9 micrometers on the land area of the grooves and a Shore D Hardness of about 40 to about 70.

29. The polishing pad in accordance with claim 2 wherein the groove pattern provides:

i. a groove stiffness quotient, GSQ, of about 0.1 to about 0.7; and ii. a groove flow quotient, GFQ, of about 0.1 to about 0.4.

30. The polishing pad in accordance with claim 2 wherein the groove pattern provides:

i. a groove stiffness quotient, GSQ, of about 0.2 to about 0.4; and ii. a groove flow quotient, GFQ, of about, 0.2 to about 0.3.

31. The hydrolytically stable pad according to claim 1 wherein the hardness of the pad decreases by less than about 30% when the pad is immersed in deionized water for 24 hours at an ambient temperature of about 25° C.

* * * * *